US010058157B2

(12) United States Patent
Brazzel et al.

(10) Patent No.: US 10,058,157 B2
(45) Date of Patent: Aug. 28, 2018

(54) HANDBAG WITH INTERCHANGEABLE LINERS

(71) Applicants: Gregory Allen Brazzel, Canyon Country, CA (US); Dominie Brazzel, Canyon Country, CA (US)

(72) Inventors: Gregory Allen Brazzel, Canyon Country, CA (US); Dominie Brazzel, Canyon Country, CA (US)

( * ) Notice: Subject to any disclaimer, the term of this patent is extended or adjusted under 35 U.S.C. 154(b) by 454 days.

(21) Appl. No.: 14/301,161

(22) Filed: Jun. 10, 2014

(65) Prior Publication Data

US 2015/0351512 A1 Dec. 10, 2015

(51) Int. Cl.

| | |
|---|---|
| ***A45C 3/06*** | (2006.01) |
| ***A45C 13/08*** | (2006.01) |
| ***A45C 13/02*** | (2006.01) |
| ***A45C 3/08*** | (2006.01) |

(52) U.S. Cl.

CPC ..... *A45C 13/08* (2013.01); *A45C 3/08* (2013.01); *A45C 13/02* (2013.01); *A45C 2013/026* (2013.01); *A45C 2200/10* (2013.01)

(58) Field of Classification Search

CPC .. A45C 3/08; A45C 3/06; A45C 13/08; A45C 13/02; A45C 7/0086

USPC ..... 150/103–105, 113, 118; 190/107–110; 383/106; D3/318

See application file for complete search history.

(56) References Cited

U.S. PATENT DOCUMENTS

| | | | | |
|---|---|---|---|---|
| 4,112,991 | A * | 9/1978 | Barbaresi | A45C 3/00 150/104 |
| 5,255,833 | A * | 10/1993 | McAllister | A45F 3/02 150/110 |
| 6,971,424 | B1 * | 12/2005 | Angevine | A45C 3/08 150/103 |
| 2002/0029831 | A1 * | 3/2002 | Pendergrass | A45C 3/06 150/105 |
| 2008/0230157 | A1 * | 9/2008 | Whiting | A45C 13/02 150/104 |

* cited by examiner

*Primary Examiner* — Fenn C Mathew
*Assistant Examiner* — Cynthia Collado
(74) *Attorney, Agent, or Firm* — Dodd Call Black, PLLC; Dustin Call

(57) ABSTRACT

A customizable handbag. The customizable handbag includes an outer shell, wherein a portion of the outer shell is transparent. The customizable handbag also includes a liner. The liner is configured to fit within the outer shell and be at least partially seen through the transparent portion of outer shell.

20 Claims, 3 Drawing Sheets

HANDBAG WITH INTERCHANGEABLE LINERS

CROSS-REFERENCE TO RELATED APPLICATIONS

Not applicable.

BACKGROUND OF THE INVENTION

A handbag has become an important fashion accessory for women. Indeed, some women change handbags as often as they change their clothes, picking a handbag that matches other fashion choices, such as clothing, shoes, etc., and occasions. However, for many women this is prohibitively expensive. That is, most women cannot afford the cost of multiple handbags or the time that it takes to move possessions between handbags.

Accordingly, there is a need in the art for a handbag that can be easily customized to an occasion without the cost of purchasing multiple handbags.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a customizable handbag. The customizable handbag includes an outer shell, wherein a portion of the outer shell is transparent. The customizable handbag also includes a liner. The liner is configured to fit within the outer shell and be at least partially seen through the transparent portion of outer shell.

Another example embodiment includes a customizable handbag. The customizable handbag includes an outer shell, wherein a portion of the outer shell is transparent. The customizable handbag also includes a liner. The liner is configured to fit within the outer shell and be at least partially seen through the transparent portion of outer shell. The liner includes a design, a closure configured to allow the user to open or close a portion of the liner and an attachment configured to secure the liner to the outer shell.

Another example embodiment includes a customizable handbag. The customizable handbag includes an outer shell. The outer shell includes a handle. The outer shell also includes a body. The body is configured to support the contents of the customizable handbag and a portion of the body is transparent. The outer shell further includes a closure configured to allow the user to open or close a portion of the outer shell. The customizable handbag also includes a liner. The liner is configured to fit within the outer shell and be at least partially seen through the transparent portion of outer shell. The liner includes a design, a closure configured to allow the user to open or close a portion of the liner and an attachment configured to secure the liner to the outer shell.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
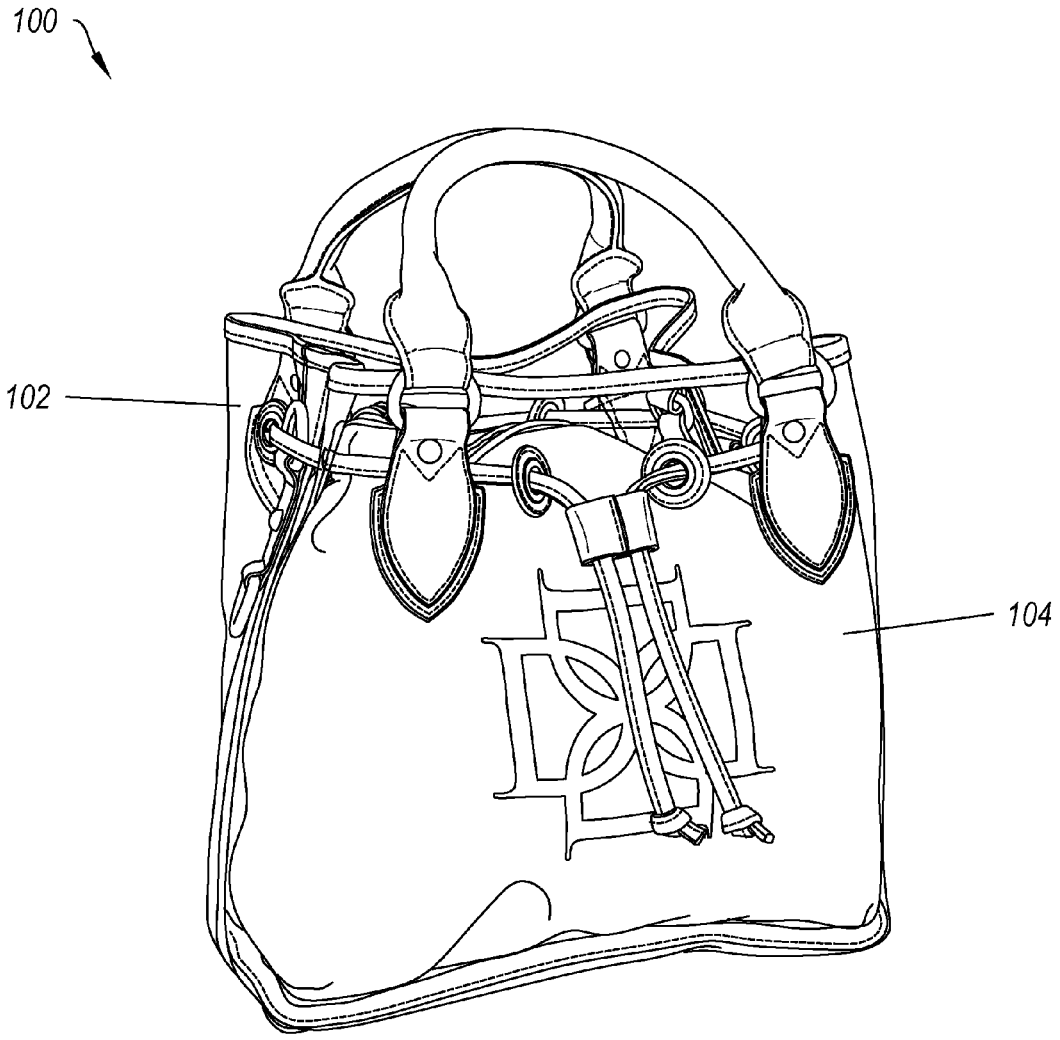
FIG. 1 illustrates an example of a customizable handbag.

FIG. 1 illustrates an example of a customizable handbag 100. The customizable handbag 100 allows a user to change styles without obtaining a new handbag. I.e., the customizable handbag 100 includes parts that can be changed in order to change the style and/or look as desired by the user. A handbag, also purse or pouch in American English, is a medium-to-large bag, usually with one or more handles, that is often fashionably designed, typically used by women, to hold personal items such as wallet/coins, keys, a mobile phone, books, a pen and paper, cosmetics and jewelry, a hairbrush, contraceptives, personal protection items such as pepper spray or other desired items. As used herein, a handbag includes a tote, clutch, purse, pouch or any other bag or container.

FIG. 1 shows that the customizable handbag 100 can include an outer shell 102. The outer shell 102 can contain the other elements of the customizable handbag 100 and can help ensure that the other elements of the customizable handbag 100 can work with one another. Additionally or alternatively, the outer shell 102 can be used to protect the elements of the customizable handbag 100. In particular, the outer shell 102 can protect elements that are susceptible to wear during use or storage. The outer shell 102 can be made of any material which is configured to perform the functions of the outer shell 102. For example, the outer shell 102 can be made of plastic, cloth, leather or any other suitable material. As used in the specification and the claims, the phrase "configured to" denotes an actual state of configuration that fundamentally ties recited elements to the physical characteristics of the recited structure. As a result, the phrase "configured to" reaches well beyond merely describing functional language or intended use since the phrase actively recites an actual state of configuration.

FIG. 1 also shows that the customizable handbag 100 can include a liner 104. The liner 104 is visible through at least a portion of the outer shell 102. That is the liner 104 includes a pattern or design that is visible through all or part of the outer shell 102. The liner 104 can be changed to update the look or design of the customizable handbag 100.

Figure 2:
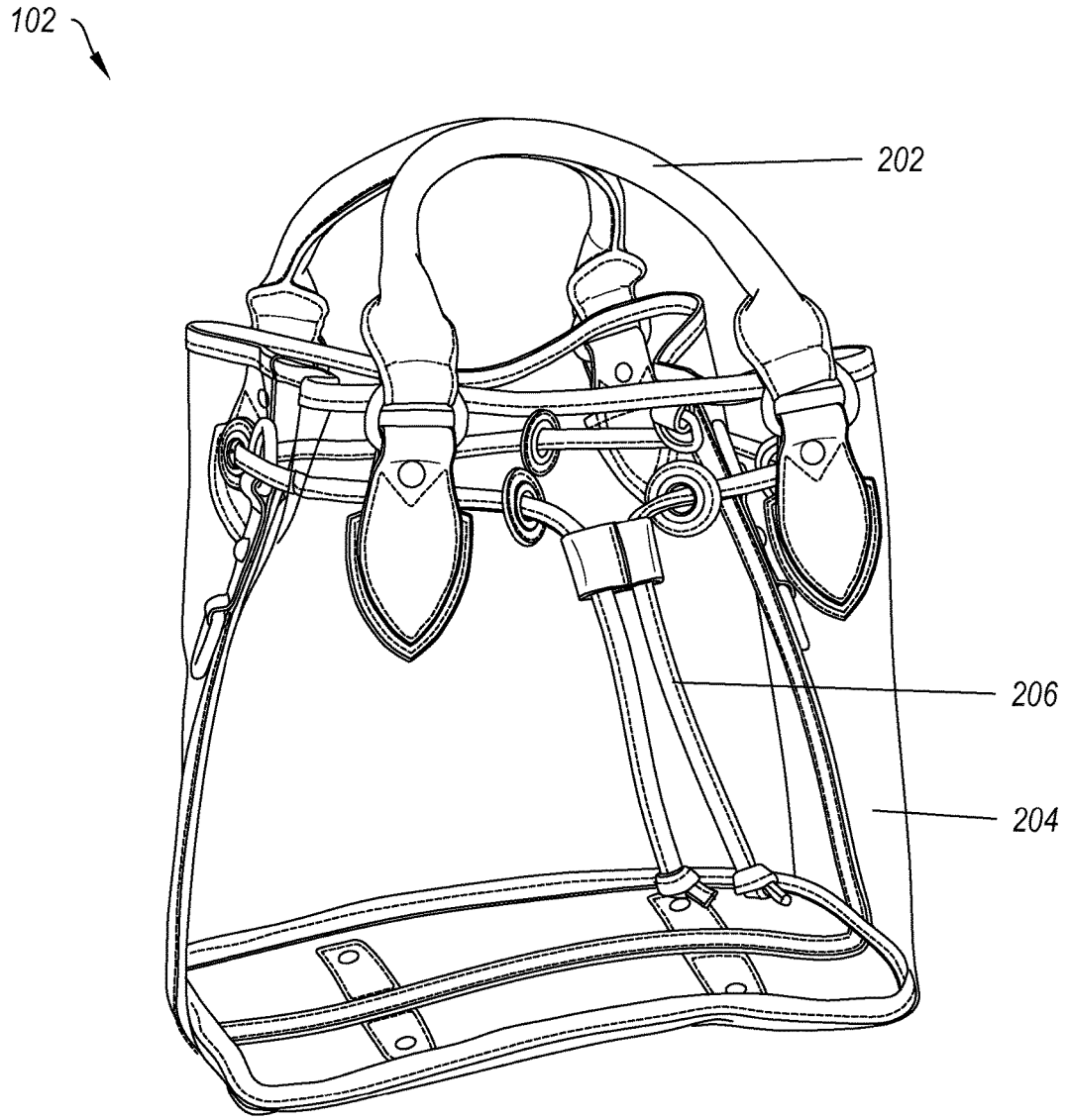
FIG. 2 illustrates an example of an outer shell.

FIG. 2 illustrates an example of an outer shell 102. The outer shell 102 constitutes an outer portion of a customizable handbag, such as the customizable handbag 100 of FIG. 1. I.e. the outer shell can remain the same, or have a tinted handbag substituted, regardless of other portions which can be changed to customize the user's handbag.

FIG. 2 shows that the outer shell 102 includes one or more handles 202. The one or more handles 202 allow the outer shell 102 to be carried by a user. For example, the handles 202 can include straps or loops that can be placed on the user's shoulders, allow the user to carry the bag by hand, to hang the customizable handbag or otherwise support the customizable handbag. The handles 202 can include plastic leather, cloth, or any other material and can include any desired design.

FIG. 2 also shows that the outer shell 102 can include a body 204. The body 204 is mostly or completely transparent, allowing a liner within the outer shell 102 to be viewed by others. One of skill in the art will appreciate that in addition to being transparent, the body 204 can be tinted. I.e., the body 204 may have coloring, rather than being clear, in addition to being transparent. Additionally or alternatively, the body 204 is of sufficient strength to support the contents of the customizable handbag. I.e., the body 102 must include material that can support the contents when the customizable handbag is carried or hung by the user. The body 204 can be any desired size and shape.

FIG. 2 further shows that the outer shell 102 can include a closure 206. The closure 206 allows the user to open or close a portion of the outer shell 102 to add or remove contents. Specifically, the closure 206 allows a user to close the outer shell 102 ensuring that the contents remain within the outer shell 102 until the user desires to remove part or all of the contents. The closure 206 can include a zipper, a draw string, a tie, snaps, buttons, a magnetic closure, a hook and loop fastener or any other desired closure.

Figure 3:
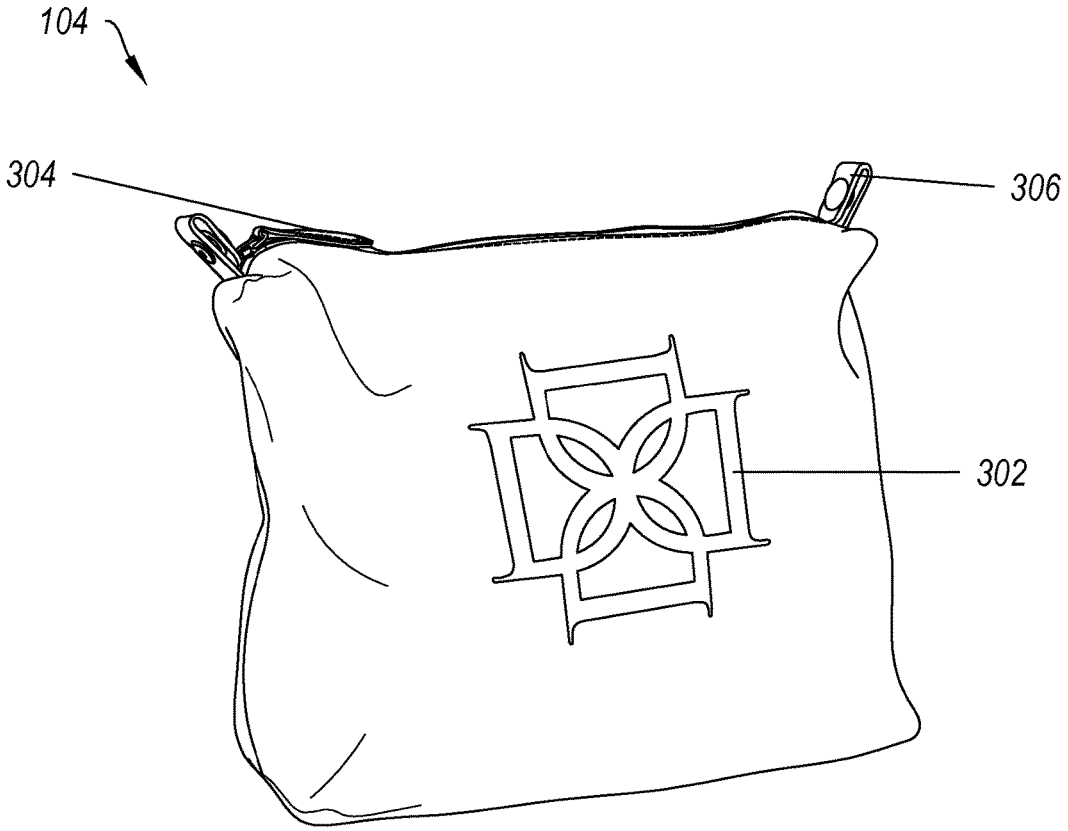
FIG. 3 illustrates an example of a liner.

FIG. 3 illustrates an example of a liner 104. The liner 104 includes an interchangeable case that can be used to customize a handbag. In particular, the liner 104 can include a pattern or design that is visible through the outer shell of a handbag. The liner 104 can then be exchanged for a liner 104 with a different pattern or design, allowing the user to change the look of the customizable handbag. Additionally or alternatively, the liner 104 can contain the contents of the customizable handbag. I.e., by changing the liner 104 within the customizable handbag the user can change the contents of the customizable handbag more quickly than moving the contents by hand or individually. The liner 104 can be sized to fit within an outer shell, such as the outer shell 102 of FIG. 2. I.e., the liner 104 can be sized to fit within an outer shell, completely or partially filling the outer shell and changing the look of a handbag.

FIG. 3 shows that the liner 104 can include a design 302. The design 302 provides a look to the liner which can be viewed through the outer shell. The design 302 can include a logo, such as professional or college sports team or corporate brands, a pattern, an image, such as a picture or drawing, or any other desired features. The design 302 can be placed before sale or can be added by the user.

FIG. 3 also shows that the liner 104 can include a closure 304. The closure 304 allows the user to open or close a portion of the liner 104 to add or remove contents. Specifically, the closure 304 allows a user to close the liner 104 ensuring that the contents remain within the liner 104 until the user desires to remove part or all of the contents. The closure 304 can include a zipper, a draw string, a tie, snaps, buttons, a magnetic closure, a hook and loop fastener or any other desired closure.

FIG. 3 further shows that the liner 104 can include an attachment 306. The attachment 306 is configured to secure the liner 104 to an outer shell, such as the outer shell 102 of FIG. 2. The attachment can include a loop which passes through the outer shell and then connects to itself, buttons, snaps, a zipper, a magnetic closure, a hook and loop fastener or any other desired attachment mechanism. Additionally or alternatively, the attachment 306 can include materials in the liner 104 and/or outer shell which are attracted to each other (like "cling wrap"). I.e., the liner 104 and outer shell can be attracted to one another (either from static charge or because low molecular weight additives are put into a high molecular weight host of different composition, they tend to not mix—they form separate phases—and when the materials come in contact the additives seek out and associates with the additives in the contacting surface).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A customizable handbag, the customizable handbag comprising:
- an outer shell, wherein:
  - a portion of the outer shell is transparent; and
  - the outer shell includes:
    - a first metal ring, wherein the first metal ring is:
      - attached to a first end of the outer shell; and
      - configured to receive a first tab; and
    - a second metal ring, wherein the second metal ring is:
      - attached to a second end of the outer shell, wherein the second end is opposite the first end; and
      - configured to receive a second tab,
- a liner, wherein the liner is configured to:
  - fit entirely within the outer shell; and
  - be at least partially seen through the transparent portion of outer shell;
- an attachment, the attachment:
  - configured to secure the liner to the outer shell; and
  - including:
    - the first tab, wherein the first tab:
      - is attached to a first end of the liner; and
      - includes:
        - a strip of material configured to pass through a portion of the outer shell;
        - a first connector on a first portion of the first tab; and
        - a second connector on a second portion of the first tab, wherein the second connector is complementary to the first connector; and
    - the second tab, wherein the second tab:
      - is attached to a second end of the liner, wherein the second end is opposite the first end; and
      - includes:
        - a strip of material configured to pass through a portion of the outer shell;
        - a first connector on a first portion of the second tab; and
        - a second connector on a second portion of the second tab, wherein the second connector is complementary to the first connector.

2. The customizable handbag of claim 1, wherein:
- the first connector of the first tab is the same as the first connector of the second tab; and
- the second connector of the first tab is the same as second connector of the second tab.

3. The customizable handbag of claim 1, wherein the first connector and the second connector of the first tab collectively includes at least one of:
a button;
a snap;
a magnetic closure; or
a hook and loop fastener.

4. The customizable handbag of claim 1, wherein the first metal ring includes:
a D-ring.

5. The customizable handbag of claim 1, wherein the outer shell includes:
a pliable plastic.

6. The customizable handbag of claim 1, wherein the transparent portion of the outer shell includes:
tinting.

7. A customizable handbag, the customizable handbag comprising:
a pliable outer shell, wherein:
a portion of the outer shell is transparent; and
the outer shell includes:
a first metal ring, wherein the first metal ring is:
attached to a first end of the outer shell; and
configured to receive a first tab; and
a second metal ring, wherein the second metal ring is:
attached to a second end of the outer shell, wherein the second end is opposite the first end; and
configured to receive a second tab,
a pliable liner, wherein the liner:
is configured to:
fit entirely within the outer shell; and
be at least partially seen through the transparent portion of the body of the outer shell; and
includes:
a design;
a closure configured to allow the user to open or close a portion of the liner independent of the outer shell; and
an attachment configured to secure the liner to the outer shell, wherein the attachment includes;
the first tab, wherein the first tab:
is attached to a first end of the liner; and
includes:
a strip of material configured to pass through a portion of the outer shell;
a first connector on a first portion of the first tab; and
a second connector on a second portion of the first tab, wherein the second connector is complementary to the first connector; and
the second tab, wherein the second tab:
is attached to a second end of the liner, wherein the second end is opposite the first end; and
includes:
a strip of material configured to pass through a portion of the outer shell;
a first connector on a first portion of the second tab; and
a second connector on a second portion of the second tab, wherein the second connector is complementary to the first connector.

8. The customizable handbag of claim 7, wherein the design includes a logo of a professional sports team.

9. The customizable handbag of claim 7, wherein the design includes a corporate logo.

10. The customizable handbag of claim 7, wherein the design includes a pattern.

11. The customizable handbag of claim 7, wherein the design includes an image.

12. The customizable handbag of claim 7, wherein the design includes a logo of a college sports team.

13. A customizable handbag, the customizable handbag comprising:
a pliable outer shell, the outer shell including:
a handle
a body, wherein:
the body is configured to support the contents of the customizable handbag; and
the body includes a pliable plastic;
a portion of the body is transparent;
a first closure configured to allow the user to open or close a portion of the outer shell; and
a first D-ring attached to the exterior of a first side of the outer shell, wherein the first D-ring is configured to allow the attachment to an external device; and
a second D-ring attached to the exterior of a second side of the outer shell, wherein:
the second side of the outer shell is opposite the first side of the outer shell; and
the second D-ring is configured to allow a second attachment point to the external device; and
a pliable liner, wherein the liner:
is configured to:
fit completely within the outer shell when the outer shell is closed; and
be at least partially seen through the outer shell; and
includes:
a design;
a second closure configured to allow the user to open or completely close a portion of the liner independent of the first closure the outer shell; and
an attachment configured to secure the liner to the outer shell,
wherein the attachment includes;
a first tab, wherein the first tab:
is attached to a first end of the liner; and
includes:
a strip of material configured to pass through a first D-ring;
a first connector on a first portion of the first tab; and
a second connector on a second portion of the first tab, wherein the second connector is complementary to the first connector; and
a second tab, wherein the second tab:
is attached to a second end of the liner, wherein the second end is opposite the first end; and
includes:
a strip of material configured to pass through a second D-ring;
a first connector on a first portion of the second tab; and
a second connector on a second portion of the second tab, wherein the second connector is complementary to the first connector
the first D-ring, wherein the first D-ring is:
attached to the interior of the first end of the outer shell; and
configured to receive the first tab; and the second D-ring, wherein the second D-ring is:

attached to the interior of the second end of the outer shell; and configured to receive the second tab.

14. The customizable handbag of claim 13, wherein the first closure includes at least one of:

a zipper; or a magnetic closure.

15. The customizable handbag of claim 13, wherein the first closure includes a draw string.

16. The customizable handbag of claim 13, wherein the first closure includes a tie.

17. The customizable handbag of claim 13, wherein the second closure includes at least one of:

a zipper;

a magnetic closure; or a draw string.

18. The customizable handbag of claim 13, wherein the outer shell and the liner are attracted to one another.

19. The customizable handbag of claim 13, wherein the second closure includes a tie.

20. The customizable handbag of claim 13, wherein the external device includes a strap.

* * * * *